US011058168B2

(12) United States Patent
Oroszi et al.

(10) Patent No.: US 11,058,168 B2
(45) Date of Patent: Jul. 13, 2021

(54) SURFACE STRUCTURE FOR SPORTS BOOTS WITH INCREASED BALL-CONTACT PROPERTIES AND METHOD FOR PREPARING THE STRUCTURE

(71) Applicants: László Oroszi, Val (HU); Mihály István Lantos, Budapest (HU)

(72) Inventors: László Oroszi, Val (HU); Mihály István Lantos, Budapest (HU)

( * ) Notice: Subject to any disclaimer, the term of this patent is extended or adjusted under 35 U.S.C. 154(b) by 1088 days.

(21) Appl. No.: 14/414,887

(22) PCT Filed: Jul. 25, 2013

(86) PCT No.: PCT/HU2013/000076
§ 371 (c)(1),
(2) Date: Jan. 14, 2015

(87) PCT Pub. No.: WO2014/016629
PCT Pub. Date: Jan. 30, 2014

(65) Prior Publication Data

US 2015/0128453 A1 May 14, 2015

(30) Foreign Application Priority Data

Jul. 27, 2012 (HU) ..... P1200447

(51) Int. Cl.
*A43B 5/02* (2006.01)
*A43B 23/02* (2006.01)
(Continued)

(52) U.S. Cl.
CPC ..... *A43B 5/025* (2013.01); *A43B 13/22* (2013.01); *A43B 13/223* (2013.01);
(Continued)

(58) Field of Classification Search
CPC ..... A43B 5/025; A43B 13/22; A43B 13/223; A43B 23/0205; A43B 23/0225; A43C 15/02; A43C 15/16
(Continued)

(56) References Cited

U.S. PATENT DOCUMENTS 2,772,489 A * 12/1956 Porter ..... A43B 7/32 2/2.5
3,191,321 A * 6/1965 Brutting ..... A43B 5/02 36/133
(Continued)

FOREIGN PATENT DOCUMENTS

CN 2064177 U 10/1990
DE 1930740 U 1/1966
(Continued)

OTHER PUBLICATIONS

Extended European Search Report for European Application No. 13823414.1, issued by the European Patent Office, dated Feb. 2, 2016.
(Continued)

*Primary Examiner* — Sharon M Prange
(74) *Attorney, Agent, or Firm* — Handal & Morofsky LLC; Anthony H. Handal

(57) ABSTRACT

A surface structure for sports boots used for ball games having increased ball-contact properties where each boot has an upper part and a sole and the upper part has an outer surface used for shooting a ball, wherein at least a part of said ball shooting outer surface comprises a coating that has an adhesive substance covering said outer surface and a grained structure embedded in and kept by the adhesive. The grained structure comprises discrete granules of a resilient material, wherein between the adhesive and the outer surface of the upper part and between the adhesive and the granules a stable and durable bonding is provided, and the granules
(Continued)

have outer surfaces that provide an improved contact with the ball when getting in contact with it.

9 Claims, 6 Drawing Sheets

(51) Int. Cl.
*A43B 13/22* (2006.01)
*A43C 15/16* (2006.01)
*A43C 15/02* (2006.01)

(52) U.S. Cl.
CPC ..... *A43B 23/0205* (2013.01); *A43C 15/02* (2013.01); *A43C 15/16* (2013.01)

(58) Field of Classification Search
USPC ..... 36/134, 133, 114
See application file for complete search history.

(56) References Cited

U.S. PATENT DOCUMENTS 3,768,183 A * 10/1973 Fessenden ..... A43C 15/167 36/67 R
4,716,663 A * 1/1988 Steinhauser ..... A43B 5/003 36/113
5,437,112 A * 8/1995 Johnston ..... A43B 5/02 36/128
6,237,251 B1 * 5/2001 Litchfield ..... A43B 1/0072 36/114
6,523,282 B1 * 2/2003 Johnston ..... A43B 5/02 36/133
8,338,697 B2 * 12/2012 Hoya ..... C08L 23/0815 136/251
9,009,992 B2 * 4/2015 Baker ..... A43B 5/025 36/133
2005/0144812 A1 * 7/2005 Wheeler ..... A43B 3/0078 36/133
2006/0196088 A1 * 9/2006 Forse ..... A43B 5/02 36/133
2008/0005930 A1 * 1/2008 Skirrow ..... A43B 1/0072 36/32 R
2008/0271344 A1 * 11/2008 Skirrow ..... A43B 1/02 36/114
2009/0007457 A1 * 1/2009 Skirrow ..... A41D 19/01558 36/133
2009/0300945 A1 * 12/2009 Droege ..... A43C 11/002 36/103
2010/0042212 A1 * 2/2010 Van Epps ..... A61F 2/12 623/8
2010/0319111 A1 * 12/2010 Berns ..... A41D 27/24 2/440
2011/0247240 A1 * 10/2011 Eder ..... A43B 1/0009 36/133
2013/0074374 A1 * 3/2013 Droege ..... A43B 5/025 36/133

FOREIGN PATENT DOCUMENTS

EP 2366299 A1 9/2011
JP H04198504 A 7/1992
KR 1020120007614 A 1/2012
RU 2173535 C1 9/2001
RU 2416345 C1 4/2011
WO 1996/032856 A2 10/1996

OTHER PUBLICATIONS

International Search Report dated Dec. 12, 2013, in International Patent Application No. PCT/HU2013/000076.

* cited by examiner

SURFACE STRUCTURE FOR SPORTS BOOTS WITH INCREASED BALL-CONTACT PROPERTIES AND METHOD FOR PREPARING THE STRUCTURE

The invention relates to a surface structure for sports boots or shoes with increased ball-contact properties, wherein the sports boots have an upper part and a sole, and at least a portion of the upper part is used for shooting a ball. The invention also relates to a method for making such surface structures. The invention can be used for sports boots used for ball games, especially for soccer and football.

It is a known property of sports boots that the way how the ball can be forwarded with them depends largely on the kind and design of their outer surfaces. While several different surface designs have been known, with time certain kinds of them have become used and widely spread.

One of such widely used surface design is described in my HU patent 222 806 that has "directing zones", provided on the useful surface area of the upper part of the boots, and these zones comprise a plurality of parallel elongated grooves on a rubber sheet positioned on the surface. In each of these zones the grooves extended in the same direction, but the directions of different zones are different and they were determined by the playing style of the user.

One of the most state-of-the-art sports boots surface design has been used in the boots of the German Company ADIDAS AG having the brand name "Lethal Zones"® available in commerce. These sports boots comprise a plurality of elongated regions or zones that close substantially an angle of around 45° with the longitudinal axis and the surface structure and shape and in given cases the material of these zones changes according to the kicking task of the associated surface area. Accordingly, one can find frontal lateral zones referred to as "first touch" wherein such zones comprise grooves and ribs that are made on a sponge-like resilient material that provide a cushioning effect for the ball that is said to result in an accurate targeting (killing) effect, and these zones operate also with vacuum. Along the sides of the boots, close to the lace slot "drive zones" are provided that have a more expressed spatial design used for more accurate and longer passes. The area comprises wider and narrower grooved stripes. At the frontal side area, that corresponds about the position of the toe, narrow "dribble" zones are provided, and these zones are spaced and have the task of providing fast and reliable contact. At the front central part of the boots a larger, "éclair-shaped" control and pass zone is provided encircled by a pair of parallel rims, and this zone is longer contact time with the ball as the other zones. Finally, centrally from the frontal toe area a sweet spot zone is provided that comprises wider, upwardly directed stripes and a portion connecting the lower ends of the stripes. These striped ribs extend more out of the surface and increase the twisting effect and speed of the ball.

A further feature of these boots is that the sole part is almost perfectly molded on the upper part and there is hardly and gap between them, whereas the solid consistency of the material of the sole provides a different impact resistance with the ball as that of the upper part, where only the thin flexible material and the feet of the player provides the impact resistance.

The resilient, rib and groove structure can also be found at this shoe design, however, there are zones of harder and softer materials, and in certain zones the shape and height of the ribs are different.

In most sports boots used earlier the zones comprised rib-groove structures made on a hard rubber base provided on the surface of one or more rubber sheets fixed on the upper part.

In case of sports boots the non-grooved surface of the upper part was smooth, and in an interesting way even the grooves and ribs had small surface roughness, i.e. the ribs themselves had smooth surfaces along their length and sloping planes.

The aforementioned largely improved design has only been made to match the style of an average player, it is a mass-produced product where there is no possibility to design and realize the position, shape and the rib-groove structure thereon to meet the individual playing style of any player.

When the ball contacts a given portion of the boots surface with varying forces, it will be deformed in a fraction of a second; and the contact area with the surface will depend on the extent of the impact force. The ball has a smooth surface and the quality and characteristics of the transitional contact between the ball and the shoe surface (e.g. the momentary adhesion of the ball to the surface) has a decisive effect on the quality of the shoot. This can be understood, since the transitional connection between the ball and the shoe determines the direction, speed and rotation of the bounced ball. This effect takes place in addition or beside the kind and speed of the kicking movement of the player, but this impact is not negligible.

If the aforementioned properties and limitations are summarized, it can be stated that one drawback of conventional designs lies in that there is no or only little possibility for the individual design, or if such is required, it can be carried out only with costs far exceeding the cost of mass-produced shoes. A further drawback is the fine, smooth shoe surface (under this notion not the spatial structure but the surface roughness is understood). Finally, a further drawback lies in that the rim of the sole or in given cases the outer surface of the laterally arranged cleats extending out downwardly from the sole and having a differing surface from that of the shoe may impose a quite different effect on the ball as the contact surface of the upper part. Under disturbed circumstances of a ball game it may often happen that the ball meets the rim or the cleat, and this generally results in an inaccurate shoot.

The primary object of the invention is to provide a method and a surface structure on sports boots used for ball games, preferably for soccer, which is capable of decreasing or eliminating these drawbacks, which can be manufactured easily and which is durable.

According to the invention it has been recognized that a grained structure of a resilient material, preferably grained rubber can be fixed by an appropriate adhesive material on the surface of the upper part of the sports boots, and the structure has a predetermined grain size and distribution. The grains will set in a stable way in the adhesive and on the so covered portions of the boots a special grainy, rough and flexible structure will be formed. This principle provides a great degree of freedom to the designer of the boots concerning the design of the upper part, the number and shapes and positioning of the covered regions. This freedom is increased by the fact on the so established surface by using a mechanical intervention or following the setting a combined heat and mechanical intervention any form or pattern of grooves/ribs can be provided. The shape, size, direction and structure of the grooves/ribs can be freely chosen that make it possible that the sports boots have largely individual properties and follow the needs of its owner or user.

Accordingly the surface of such sports boots can be designed in case of every player according to his expectations, ball handling preferences, and in case of selected key players a number of preliminary tests can be carried out to establish the exact needs of that player.

The invention is defined according to the attached claims.

The type and material of the upper part under the surface structure according to the invention has only secondary role, and even the cheapest smooth leather surface can be used as a basis to establish the surface structure according to the invention thereon. It should be noted that the rim of the sole where it meets the upper part results always in a jump in the hardness of the surface, and the ball will be reflected in a different way if it meets this boundary zone as if it met only the upper part. For the sake of decreasing this effect, the recess between the upper part and the rim of the sole can be filled with the adhesive, and this and the rim itself can be uniformly covered by the flexible grainy structure so as if the rim and the connecting zone belonged also to the upper part. If during a game the ball contacts the rim treated in this way, the same type of surface will be found as it is provided on other parts of the upper part, therefore the aforesaid bouncing problem because of the harder rim surface will not be experienced.

On the upper part, under the adhesive one can also provide spatial structures including ribs and recesses, and in that case the surface structure on the upper part can follow the shape of the surface underneath.

Further possibilities can be provided in downward direction towards the ground, namely the outer surfaces of the cleats used for preventing slipping on a grassy ground can be coated in the same way. One cannot exclude the possibility that a player in a difficult situation and position can handle the ball so that the outer surface of the cleats meets the ball.

The suggested method provides further beneficial possibilities. If a given pair of sports boots has become worn and has a greatly used surface, in given cases it has a few scratches or cracks, then it still can be covered by the structure according to the invention, and the properties of the surface under the adhesive will become irrelevant as long as the upper part can carry the structure thereon. The suggested new grained surface structure will cover and conceal all earlier defective parts. In this way the inventive solution can increase the useful term of the boots.

Finally, it can be mentioned that the covering structure or a part thereof can be removed by a grinder machine or by means of a similar abrasive way, and thereafter a new structure can be provided on the base surface. If a player dislikes a previously provided groove/rib structure, then after the removal thereof a further, more preferable surface structure can be provided on the same boots.

The invention will now be described in connection with preferable embodiments thereof, wherein reference will be made to the accompanying drawings. In the drawing.

Figure 1:
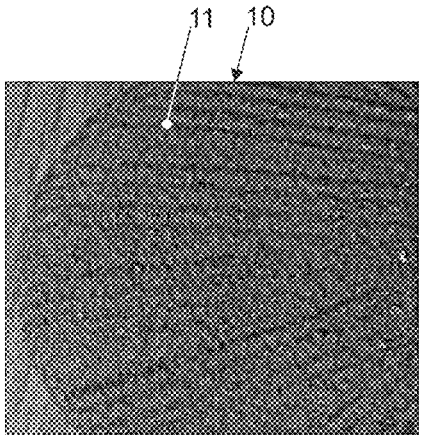
FIGS. 1 to 6 show characteristic details of pictures taken from different embodiments of the sports boots according to the invention.

For the experimental realization of the present invention a pair of existing used sports boots with leather upper part was used, and its whole surface was evenly covered by a brush with a colorless adhesive having a single component of the commercial name CONIPUR 301® made by the company BASF, 67056 Ludwigshafen, Germany. This adhesive belongs to the polyurethane family and it is polyisocyanate based and sets under the effect of the humidity of the ambient air.

In commerce several types of ground rubber can be obtained, and many of them is produced by the grinding of used tires, but there are also specifically produced rubber granulates. These rubber granulates are generally characterized by the mesh size of the sieve through which the grains are passed through after grinding. A rubber grain jigged by a sieve with a mesh size of 0.4 mm comprises grains less than 0.4 mm, and it has a certain size distribution. In most cases such a granulate automatically comprises sufficient amount of very small grains (also which are between about 50 to 100 microns), and there is no need to use a mix made of grains of different sizes.

If this condition cannot ensured, then it is advisable to use a mix that comprises 2 to 10 mass % grains smaller than 100 microns, 5 to 30 mass % grains smaller than 200 microns and the dominant components are the sieved grains between around 300 and 400 microns. The small grain size provides a good surface adhesion and the larger grains are responsible for the required coarse, rough surface that facilitate connection with the ball.

It has been found that grains larger than about 0.8 to 1 mm will not perfectly bound by the adhesive they are inclining to peel off the surface and their appearance is not too pleasing as the surface looks too coarse. It is preferred therefore to use grains smaller than about 0.8 to 1 mm and preferable which are between 0.4 and 0.3 mm or even if they are smaller than 0.2 mm. The maximum grain size will not remarkably worsen the contact properties with the ball, therefore the grain size is not too critical, and it influences rather the durability and appearance of the so obtained layer.

In case the grains are made by used car tires, it is preferred to use the properties of such tires according to which there are standard (normal) tires used in normal or warmer environment, and there are winter tires (for use under 12° C.) as they have good surface adhesion in their associated temperature ranges. Therefore in winter it is preferable to cover the sports boots with grains made of winter tires.

The chipping of the grains from used tires or other rubber materials can also take place by using a water jet of very high pressure. This technology can result in preferred grain shapes and sizes.

A rubber grain with the aforementioned size distribution was dispersed in an excess amount on the surface coated by the adhesive, then the outer surface was slightly pressed either with hands wearing rubber gloves or by a soft textile material, then the excess amount of grains were removed by hitting the boots to a hard body.

Depending on the ambient temperature and on the humidity of air the surface will sufficiently set in about 12 to 24 hours.

After the adhesive has been set, the not bound grains can be removed from the surface by using a soft rug. After removal of these grains the remaining surface will be sufficiently stable, coarse and it has an excellent contact adhesion with the ball.

Similar result are obtained if as starting material not the aforementioned adhesive but other members of the same manufacturer company of its CONIPUR® product family is chosen namely the types CONIPUR 302®, CONIPUR 315® or CONIPUR 322®. These are adhesives with slightly different compositions and setting times, but concerning their connection to the rubber granules, they are basically equivalent.

As far as the administration of the adhesive is concerned, if the whole surface should be coated, then the most preferred method is the use of a brush. In cases when only segments of the surface should be coated it is advisable to mark the boundaries of these segments prior to the application of the adhesive by an appropriate pen or marking means. In case of larger numbers it is worthwhile to use templates or masks that comprise respective windows where the coating should be provided. After masking the application of the adhesive by brush is still preferred.

In cases where the coating should be provided in isolated stripes or segments, it can be preferable to work with a tool using a cylinder of soft, slightly hygroscopic material, wherein the adhesive can be fed directly to the opposite side of the cylinder from a squeeze-tube attached to the handle of the tool by pressing the tube.

There are several known ways and methods how surfaces can be covered by an adhesive and by keeping the required safety measures; and any of these can be used for the application of the adhesive.

It should be noted that the adhesive may also be applied on the rim (edge) of the sole of the boots and any groove formed at the connection of the upper part and this rim, then on these covered surfaces the rubber grains should also be placed.

If a fast setting is required, then to such purposes there are fast-setting adhesives that adhere equally well to the leather (or plastic) surface of the upper part and to the rubber grains. An example for such a fast-setting adhesive, which is preferred for the present invention, is the cianoacrylate-based adhesive of the type LOCTITE 4850® manufactured by the German company Henkel AG.

In case of coating a leather surface, it is advisable to clean the surface prior to the application of the adhesive by a cleaning liquid and there is no need for using a separate priming composition but it cannot cause any harm.

There are sports boots that comprise wholly or partially plastic shooting surfaces, and in given cases the material is slightly softened, e.g. by the use of a foam insert. In such boots prior to the administration of the grains it is preferred to carry out preparatory steps. As a first of such steps it might be worthwhile to roughen the surface by a fine abrader. In case of certain surface designs (especially where short thread-ends used for sewing extend out of the surface) a short burning can be preferred where the burning time should be as short as possible e.g. shorter than 20 sec. Under the burning effect, the outwardly projecting threads or fibres disappear but in the short treatment period the surface cannot be warmed up till the melting or deformation temperature. The subsequent cleaning can be made preferably by any acetone-based cleansing liquid.

The so prepared surface can be further treated by the application of a priming composition which evaporates within a short period of time but improves the adhesion of the adhesive. Such a priming composition can be e.g. the product type TEROSTAT 450® of the company HENKEL AG.

Following the application of the adhesive and the grains thereon and prior to the full setting of the adhesive but thereafter it may be preferable to provide a groove-rib system on places needed by the user that extend in directions according to the user's playing style or preferences. A simple way of forming the groove-rib pattern is the use of a hand tool with a roller that has an edge made to conform to the required groove-rib profile. The rolling of such a tool along the planned lines of the grooves will automatically create the required pattern. The rolling of such a tool with a small pressure does not require any specific skill. The ribbing can be provided in about 10 to 180 minutes from the application of the grains.

If the adhesive has already been set, the required ribbing can be made by a similar tool if the surfaces where the grooves-ribs should extend are heated. According to an alternative way the negative profile of the ribbing can be reproduced along an edge of a sheet that has a high specific electrical resistance. If appropriate electrical energy is coupled to the sides of the sheet, it will get warmed to a temperature of between about 150°-250° C. When this warmed tool is led along the path of the required grooves with a slight pressure, the profiled edges will form the ribbing. When the ribbing is provided in this way after the full setting of the adhesive, the ribbing has become more stable and strong than what is provided by pure mechanical way prior to the full setting.

It should be noted that both for the application of the adhesive and for the preparation of the ribbing several known methods are known or apparent to a man skilled in the art, therefore the present invention cannot be limited to any specific way of applying the adhesive or of making the ribbing.

Concerning the shape of the ribbing reference is made to the teaching comprised in the HU patent 22806 according to which it was preferred if the ribs had a slight forward inclination, i.e. a direction normal to the length of the ribs the central plane of the rib-profile closes an angle of about 5°-15° in forward direction with the plane that is normal to the corresponding shoe surface. The edge of the rib has preferable an angle between 20° and 40°.

Depending on the size and size-distribution of the grains, on the places where such coating variations. In FIGS. 1 to 6 details of sports boots designed according to different principles are shown.

In the example shown in FIG. 1 a rust colored rubber granulate was used and the figure shows a detail of the front end 10 of the boot. Here ribs 11 are diverging as spread fingers symmetrically to the central longitudinal axis so that their distance from the axis increases in forward direction. The rubber grain coating is continuous.

Figure 2:
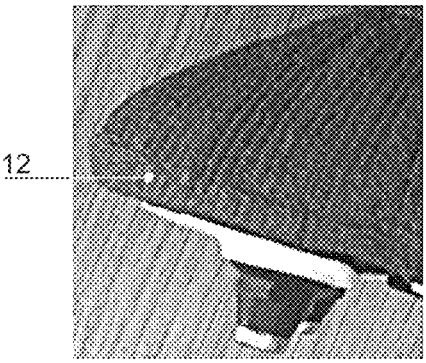

FIG. 2 shows the side view of the sports boots of FIG. 1, and here the whole edge 12 (*rim*) of the sole is also coated, whereby the surface is continuous and it is not broken or recessed in the region where the upper part meets the sole. In FIG. 2 the direction of the grooves/ribs can be seen at the front side part of the boots. The coating of the edge of the sole is preferred, because the material of the sole is much harder than the upper part attached thereto, whereas it has a different surface adhesion to the ball. If the ball meets the edge of the sole without the suggested coating, then the shooting will not always occur in the intended direction. After this edge has been coated according to the invention, then the surface adhesion to the ball will remain the same also at the edge region, and the resilience of the coating material attenuates the stiffness of the sole, therefore the shooting will occur more to the intended direction.

Figure 3:
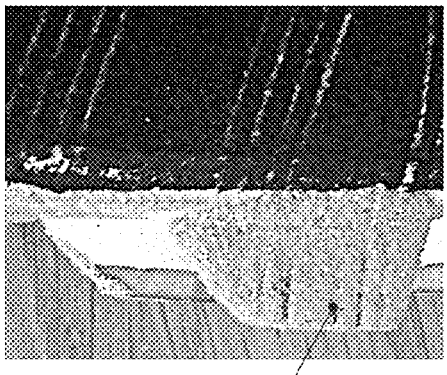

In the embodiment shown if FIG. 3 it is illustrated that not only the edge of the rim of the sole is covered as in case of the embodiment shown in FIG. 2 but also the outer surface of the comparatively large cleats 13 that can be found close to the edge of the sole. The layer on the cleat surface is also ribbed. On the basis of this picture one can easily understand and from the proportion of the size of the surface areas it follows that the ball may well hit the outer surface of the cleats 13. The surface covered by the layer according to the invention is flexible, it has just as good contact with the ball as the coated surface of the upper part, and therefore the path of the ball hitting the cleat surface will remain under control.

Figure 4:
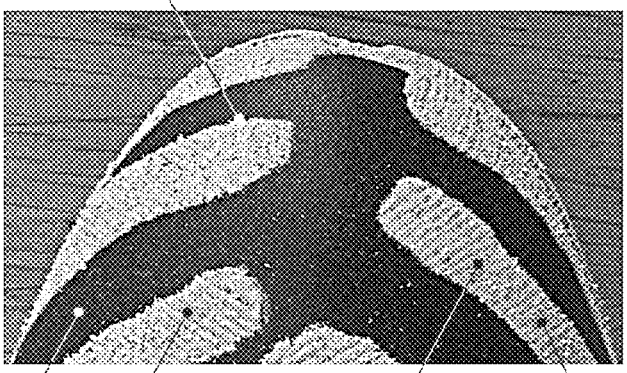

FIG. 4 shows an embodiment where the grained layer has been deposited in distinct spaced stripes 14, 15 on the upper part of the boots. An advantage of this embodiment is that the non-covered leather surfaces 16 provide some path for perspiration. The layered stripes 14, 15 have a ribbing 17 extending in skew directions. The stripes 14, 15 define an interesting pattern. When the ball meets the boundary of the pattern that represents the edge 18 of the covering layer will also influence the direction of the shoot.

Figure 5:
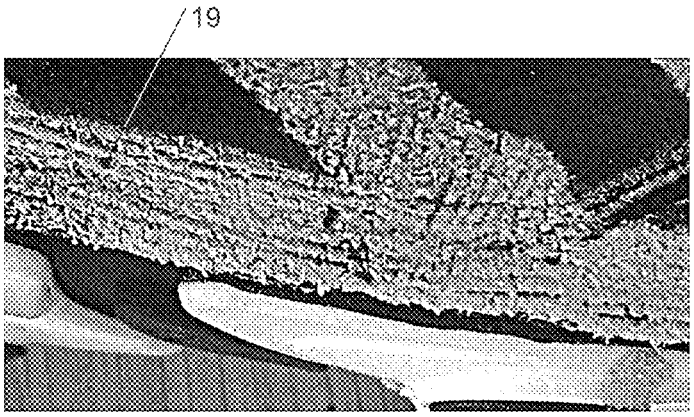

FIG. 5 shows an embodiment where the layer comprises larger and rougher grains with larger ribs/grooves 19. The picture shows an enlarged detail close to the rim of the sole. At the lowest region of the upper part the ribs/grooves can extend parallel with the plane of the sole, but slightly above this region the direction of the ribs closes already an angle with the horizontal direction.

Figure 6:
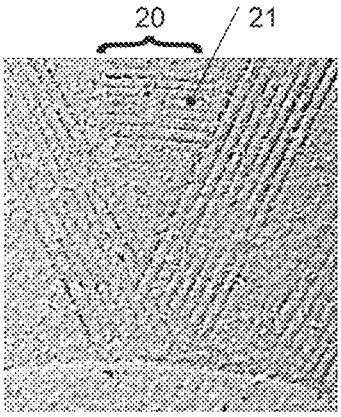

FIG. 6 illustrates the ribbing on the frontal central portion of the upper part which is similar to that shown in FIG. 1, but in the central section where a V-shaped region 20 is formed between the diverging grooves wherein ribs/grooves 21 extend in horizontal direction i.e. normal to the longitudinal axis of the boots.

FIGS. 7 to 10 show perspective views of further embodiments of the sports boots provided by the coating according to the invention.

Figure 7:
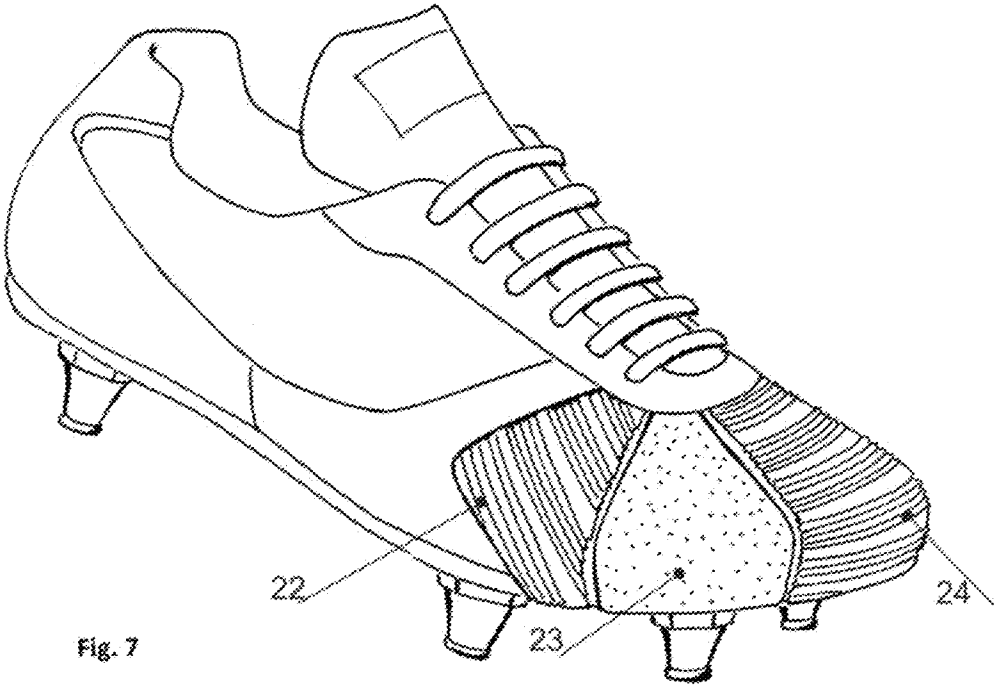
FIGS. 7 to 10 show the perspective views of further embodiments.

FIG. 7 shows the surface structures provided according to the invention on a used sports boot. The drawing shows the right frontal surface which is divided in three different zones 22, 23, 24, wherein the directions of the associated ribbings are very different. In the coated region the rim surface of the sole is also coated and its surface design follows that of the adjacent zone above it. It is worthwhile to note that in the central zone 23 there is no ribbing; and for the direction of the ball the grained coarse surface with its excellent contact with the ball is sufficient.

Figure 8:
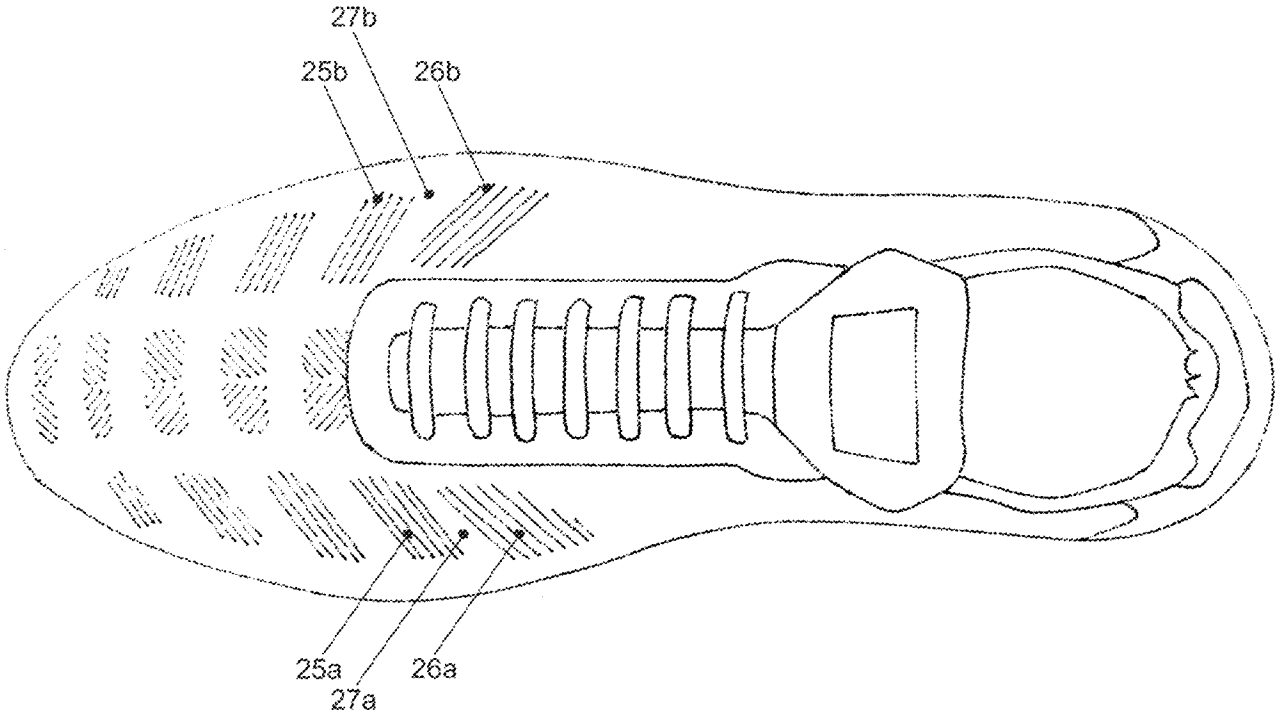

FIG. 8 shows an embodiment with a design of different philosophy, where in both sides from the central axis respective pairs of spaced ribbed zones 25*a*, 25*b* and 26*a*, 26*b* arranged behind one another are provided. The directions of the ribs in the zones are different. Between the ribbed zones only narrow spaces 27*a*, 27*b* are formed.

Figure 9:
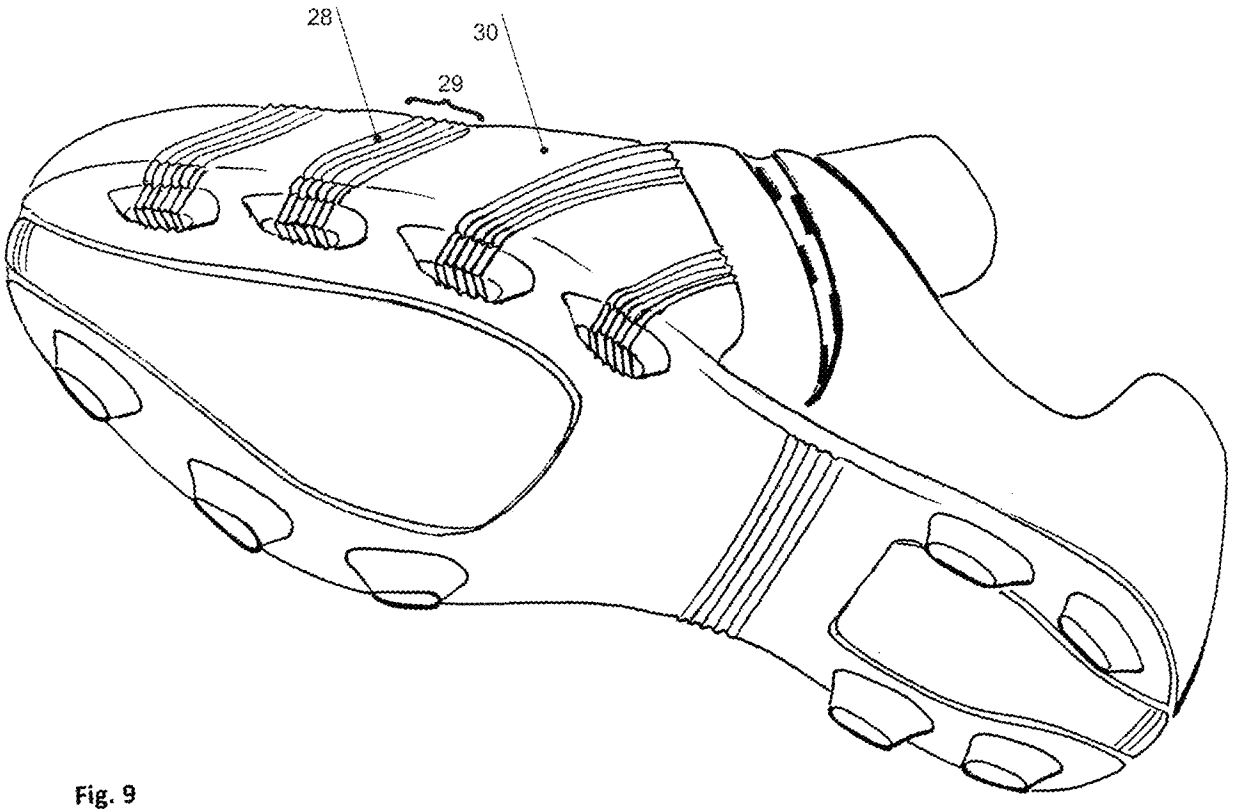

In the perspective view of FIG. 9 the design of the bottom part of the boots can be seen. The ribs 28 are provided in zones 29 designed as wide stripes with substantial spaces 30 between them, and the ribs/grooves 28 are parallel to each other and directed with a forward and downward inclination. The figure shows the cleats 13 fixed to the sole which are also coated at their outer sides and the ribs/grooves are also provided on these sides. The coating covers the connection zone between the sole and the upper part; thus the rim of the sole cannot be seen as it is perfectly hidden by the coating thereon. In this design the full surface of the boots can be used for shooting the ball.

Figure 10:
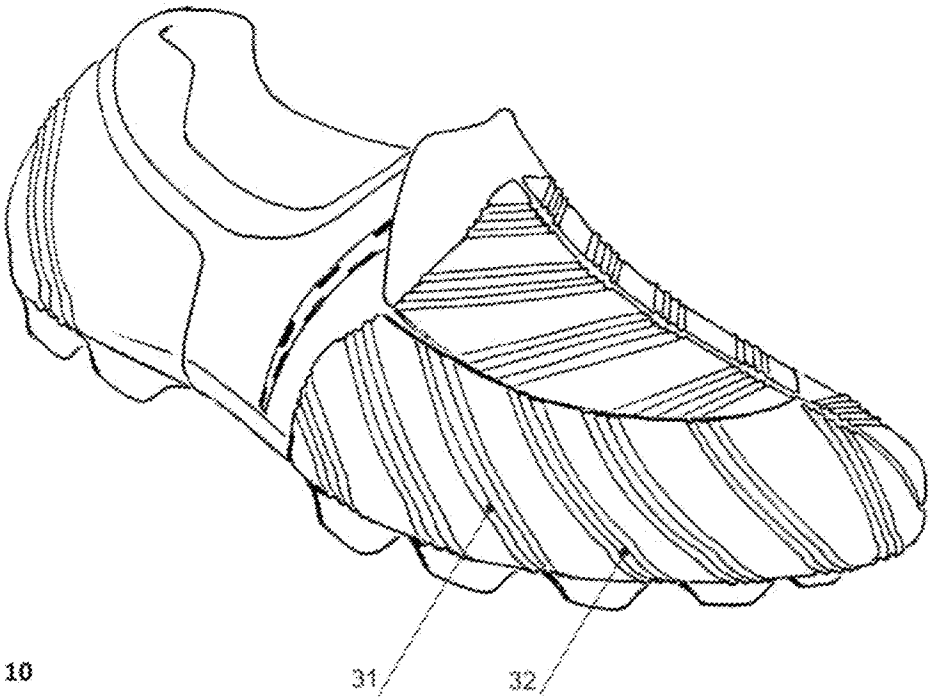

FIG. 10 shows a sport boot that has no visible lacing and has no visible large slot for the lacing either, so that the full surface of its upper part can be actually used for shooting. The surface comprises spaced coated areas 31, 32, each bearing a differently directed rib/groove structure. The rim of the sole and the outer sides of the cleats are also coated in this embodiment.

Figure 11:
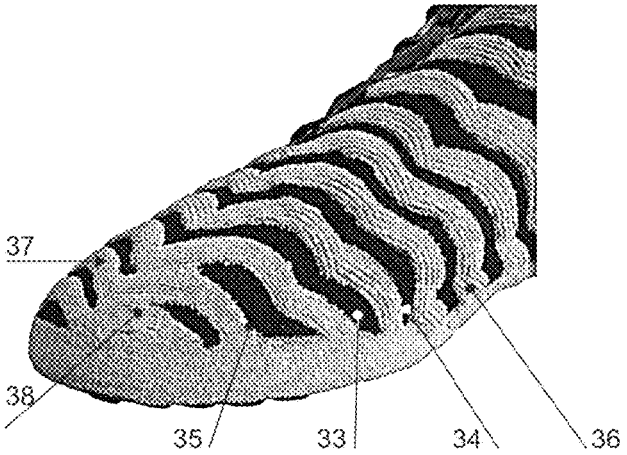
FIGS. 11 to 16 are pictures showing further embodiments and details.
Figure 12:
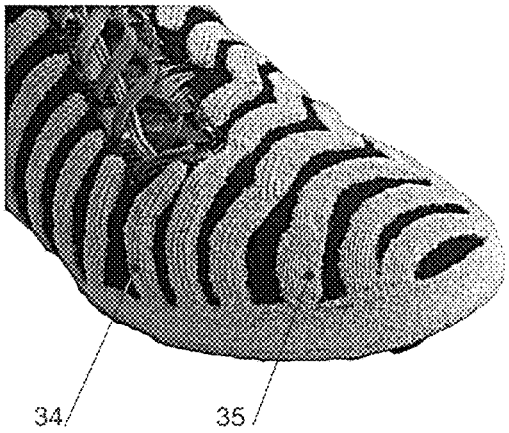

FIGS. 11 and 12 are photographic pictures taken from right and left directions of the frontal upper part of the same sports boot. The upper part is provided with a base coating 33 according to the invention as represented by the black fields. On the top of the base coating 33 a second layer or coating 34 is provided (that has a yellow color in the drawing) according to a predetermined pattern that comprises a plurality of fields with arced boundaries 35. The shape of the respective arc sections correspond to the curved meeting line of the ball with the surface on the associated surface area. The direction of any given arc influences the direction how the ball will leave the boot. In addition to the arced design of the boundaries of the pattern, this second coating 34 also comprises a ribbing 36, wherein the curved ribs/grooves follow the direction of the corresponding arc sections 35 (i.e. extend substantially parallel therewith). From the pictures it can be observed that in different parts of the surface the directions of the central radii of the associated arc section (i.e. the straight lines connecting the halving point of any arc section with the center of the arc) are directed substantially in forward or close only a small angle with the forward direction. In FIGS. 11 and 12 it can also be observed that the depth and width of the grooves 36 increase from the front part towards the rear parts of the boot, and in the frontal nose section 37 there are only very fine and small ribs/grooves 38. It has been experienced that such a gradually increasing rib design improves the accuracy of targeting.

Figure 13:
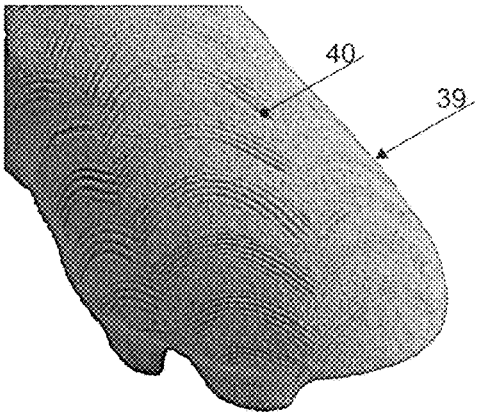
Figure 14:
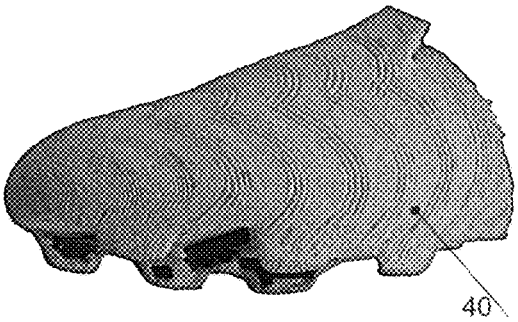

FIGS. 13 and 14 show similarly the right and left sides of a further embodiment. Here only a single coating 39 is provided, but the ribs/grooves 40 have the same arced design as in the previous embodiment, and the width and depth of the grooves 40 increases in rearward direction. It should be noted, that the design of the ribs/grooves 40 depends largely on the post where the user of the boots plays, and also depends on the ball handling preferences of the player. The center radius lines of the arc sections face also substantially in forward direction.

Figure 15:
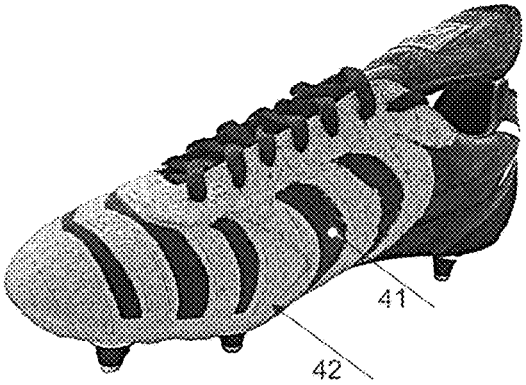
Figure 16:
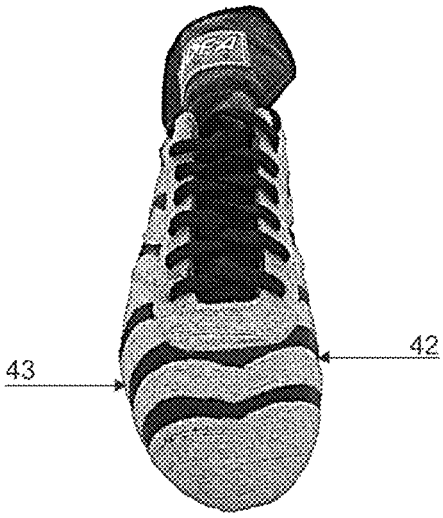

FIGS. 15 and 16 show pictures taken from the left and right sides of a further embodiment. In this embodiment the black areas 41 comprise no coating, and only the striped patterns 42 are coated, wherein the areas forming the pattern are slightly arced and the central radii of the arc sections of the boundary lines 43 extend again in forward direction. The number of the arced sections is smaller than in the previous embodiments and the coated areas are larger. The coated areas comprise again ribs/grooves which extend in parallel with the arced boundary lines of the associated coated areas.

From the numerous embodiments shown it can be understood that the present invention provides a high degree of freedom how the ribs/grooves, the coated areas or ribbed coated areas can be designed, whereby the effects of directing and targeting the ball can be realized in several ways and according to individual preferences.

The basic advantage of the present invention lies, however, in the grained coating, which is resilient and provides an excellent contact between the coated surface and the ball which enables even under cold and/or wet conditions the handling of the ball according to the intentions of the player. As mentioned earlier, the ribbing, the patterns of the coating and the The several embodiments shown represent only a fraction of all possible designs. The most accurate results can be reached if time is provided for a player to carry out experiments to find the design which meets his expectations. A further advantage of the invention lies in that with appropriate means and tools it can be removed without injury of the underlying base surface that can be coated again with a coating and structure which is more appropriate for the particular player. The possibility of carrying out repeated experiments with the same boots provides ideal solution for individual optimizations.

The coating according to the present invention is durable, it can be used even during several seasons, whereas after it has been abraded or worn, the coating can be removed and the boots can be re-used by providing always new coatings thereon.

The properties described in the present specification have been tested and confirmed by several players. According to their reports the coating has improved their handling of the ball, increased accuracy of targeting and assisted in solving their intentions to twist and direct the ball in any given circumstances. No ball-slipping or miss-shooting was reported.

The invention claimed is:

1. A sports shoe with increased ball contact properties on an outer surface thereof, comprising:

(a) a sole;

(b) an upper shoe portion connected to said sole, said upper shoe portion having an outer surface used for shooting a ball;

(c) a coating disposed on said outer surface, said coating configured into a spatial surface pattern, said spatial surface pattern defining spaced surface zones, said coating comprising:

(i) a layer of an adhesive substance disposed over and adhered to the outer surface of the upper shoe portion and defining the shape of said surface zones;

(ii) a plurality of discrete rubber grains of different size up to 0.8 mm in size positioned on the top of said layer of the adhesive substance, the discrete rubber grains forming a first grained structure, and (iii) a second adhesive layer deposited on the top of said first grained structure by a repeated application of an adhesive substance, (iv) a plurality of discrete rubber grains of different sizes up to 0.8 mm size positioned on the top of said second adhesive layer, the discrete rubber grains forming a second grained structure, wherein the outer surfaces of the discrete rubber granules in the second grained structure are free and not covered with adhesive and extend from said outer surface of said upper shoe portion a distance sufficient to provide the shoe with a desired directional shooting characteristic adapted for use in ball games, wherein adjacent ribs and grooves are provided on at least a portion of said discrete spaced zones to improve said directional shooting characteristics.

2. The sports shoe as claimed in claim 1, wherein at least a portion of said discrete spaced zones has the shape of respective arc sections that correspond to the curved meeting line of the ball with the surface on an associated surface zone.

3. The sports shoe as claimed in claim 1, wherein said ribs and grooves have depth and width increasing in size in a rearward direction.

4. The sports shoe as claimed in claim 1, wherein one of said layers is provided on the lateral edge of said sole.

5. A method for providing sports shoe with increased ball contact properties on an outer surface thereof, comprising the steps of covering discrete spaced zones of the outer surface of said sports shoe with an adhesive substance, then, before the setting of said adhesive, placing rubber grains on top of the adhesive substance to form a first layer, then depositing a second layer on the top of the first layer by a repeated application of an adhesive substance followed by a repeated application of rubber grains, and then allowing the adhesive to set, whereby the outer surfaces of the rubber grains are not covered with adhesive and extend from the surface a distance sufficient to provide the shoe with a desired directional shooting characteristic adapted for use in ball games, wherein adjacent ribs and grooves are provided on at least a portion of said discrete spaced zones by mechanical force or by the application of heat.

6. The method as claimed in claim 5, wherein a slight pressure is applied to the rubber grains after said grains are placed onto the adhesive.

7. The method as claimed in claim 5, wherein a mask is positioned prior to the step of applying the adhesive on the upper surface of the shoe, said mask comprising windows which overlie the areas where said layers should be provided.

8. The method as claimed in claim 5, wherein the rubber grains vary in size up to 0.8 mm.

9. A sports shoe with increased ball contact properties on an outer surface thereof:

(a) a sole;

(b) an upper shoe portion connected to said sole, said upper shoe portion having an outer surface used for shooting a ball;

(c) a coating disposed on said outer surface, said coating configured into a spatial surface pattern, said spatial surface pattern defining spaced surface zones, said coating comprising:

(i) a layer of an adhesive substance disposed over and adhered to the outer surface of the upper shoe portion and defining the shape of said surface zones;

(ii) a plurality of discrete rubber grains of different sizes up to 0.8 mm size positioned on the top of said layer of the adhesive substance, the discrete rubber grains forming a grained structure, wherein the outer surfaces of the discrete rubber grains in said grained structure are free and not covered with adhesive and extend from said outer surface of said upper shoe portion a distance sufficient to provide the shoe with a desired directional shooting characteristic adapted for use in ball games, wherein adjacent ribs and grooves are provided on at least a portion of said discrete spaced zones to improve said directional shooting characteristics.

* * * * *